United States Patent [19]

Turner

[11] Patent Number: 4,756,350

[45] Date of Patent: Jul. 12, 1988

[54] METHOD OF MAKING A DOOR WITH RAISED PANELS

[76] Inventor: Terry A. Turner, Rt. 2, Box 424, Prineville, Oreg. 97754

[21] Appl. No.: 98,376

[22] Filed: Sep. 18, 1987

Related U.S. Application Data

[63] Continuation-in-part of Ser. No. 934,344, Nov. 24, 1986, Pat. No. 4,704,834, and a continuation-in-part of Ser. No. 16,928, Feb. 12, 1987, Pat. No. 4,702,054.

[51] Int. Cl.[4] ..... B27D 1/00; B27F 7/00

[52] U.S. Cl. ..... 144/346; 144/355; 156/256

[58] Field of Search ..... 52/311; 156/256, 258, 156/267; 144/344, 345, 346, 351, 355

[56] References Cited

U.S. PATENT DOCUMENTS 3,829,337 8/1974 Cheng ..... 144/351

FOREIGN PATENT DOCUMENTS 2260456 6/1974 Fed. Rep. of Germany .

*Primary Examiner*—W. Donald Bray

*Attorney, Agent, or Firm*—Kolisch, Hartwell & Dickinson

[57] ABSTRACT

A method of making a panel-style door which includes forming elongate channels in a core panel, with each channel extending in a rectangular course and encompassing a rectangular region. A veneer overlay is applied to cover these rectangular regions and the surfaces bottoming the channels which encompass the rectangular regions. Inlay strips are placed in the channels to cover margins of the veneer overlay so applied. Another veneer overlay is applied to cover remaining portions of the core panel and margins of the inlay strips.

9 Claims, 1 Drawing Sheet

METHOD OF MAKING A DOOR WITH RAISED PANELS

This application is a continuation-in-part of prior filed application entitled "Raised Panel-Style Door" having Ser. No. 06/934,344, filed Nov. 24, 1986 now U.S. Pat. No. 4,704,834, and a continuation-in-part of prior filed application entitled "Door with Raised Panels" having Ser. No. 07/016,928, filed Feb. 12, 1987 now U.S. Pat. No. 4,702,054.

BACKGROUND AND SUMMARY OF THE INVENTION

This invention relates to a raised panel door and more particularly to a method of manufacturing such a door wherein the door is prepared from a continuous core or core panel extending within the door and serving to strengthen the door and impart other characteristics, such as improved resistance to break in, fire resistance, lessened sound transmission, and increased durability.

A conventional panel door comprises what is known as stiles and rails extending vertically and horizontally in the door. The rectangular spaces which are bounded by these stiles and rails are filled with panels, and these normally have tapered marginal edges that seat within grooves presented by the stiles and rails. A panel door of this description typically may be made of decorative wood, such as oak, etc., and because of its aesthetically pleasing appearance is widely sold.

While a conventional door has a pleasing appearance, because of its material content and structure, the door suffers durability, security, and safety problems that detract from its utility. Further explaining, under the stress of normal usage and the passage of time, the stiles and rails tend to sag, warp, and split or separate from each other with loosening of the panels which they encompass. The panels themselves are relatively easily broken out for the purpose of breaking through the door. The door provides a relatively poor barrier to the transmission of sound and offers little resistance to fire. Furthermore, the construction of the door is such that it is difficult to produce with a veneer overlay covering less expensive construction materials within the interior of the door.

The door of this invention is related to the door of the earlier filed applications above referred to in that such may be manufactured from a continuous core. However, features are incorporated into the door of this invention promoting economies in manufacture, and savings made in the materials used in constructing the door.

Accordingly, an object of the invention is to provide an improved method of making a panel-style door where such is prepared from a continuous core which forms the interior of the door as completed.

Another object of the invention is to provide a method of making a panel-style door which features the production of a channel in the face of a panel core which extends in a rectangular course as does a picture frame, and which encompasses a rectangular region of the surface of the core panel separated by the channel from laterally outwardly disposed regions of the core panel surface. With the application of veneer overlays and inlay strips, a door is producible which is almost indistinguishable from a conventional stile- and rail-type door.

The door is producible with very little wastage of material. The core panel from which the door is built may be made of plywood or a composite material, such as particle board, or of a material selected for fire resistance, such as a treated panel or a panel having extending within it a fire resistant or fire retardant layer. The particular make up of the core panel is dependent to a great extent on the intended use of the door, the fire retardant qualities desired, the resistance to breakage desired, etc.

These and other objects and advantages are obtained by the invention, which will become more fully apparent from the following description which is to be taken in conjunction with the accompanying drawings, wherein.

Figure 1:
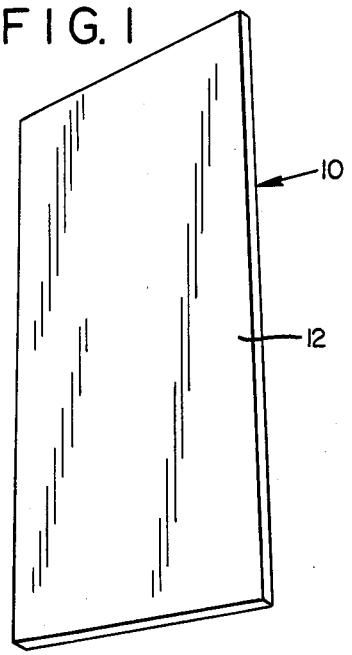
FIG. 1 is a perspective view illustrating a panel, such as may be utilized as the core of a door.

Describing now the invention in more detail, in the manufacture of a door, a core panel is selected which has a rectangular outline, and length and width dimensions substantially corresponding to those of the final door. In FIG. 1, such a panel is illustrated at 10, and is surfaced by surface 12. As earlier described, the panel may conveniently be made of plywood, of a composite material, such as particle board, or of a material selected for fire resistance, such as a treated panel, etc., with the particular make up of the core panel being dictated through the use intended for the final door, cost considerations, etc.

Figure 2:
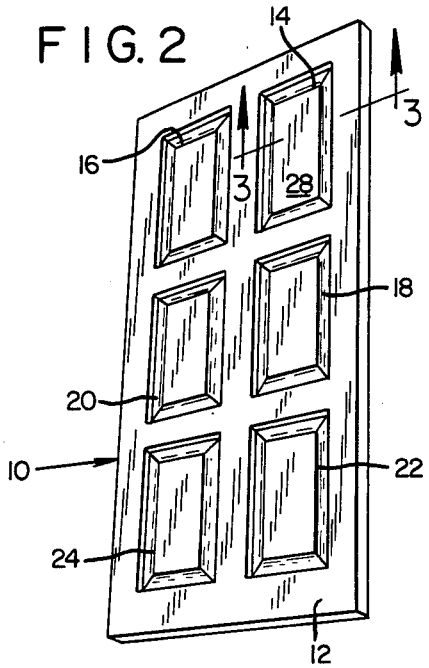
FIG. 2 is a perspective view illustrating the panel after the preparation on the face thereof of multiple channels, each extending in a rectangular course as does a picture frame.

As a first step in the manufacture of the door, multiple channels are prepared in the face of the panel, each extending in a rectangular course as does a picture frame. Each channel encompasses a rectangular region which, in the completed door and when properly overlaid, simulates a panel in a panel-style door. The channels are prepared by cutting or routing out material from the core panel. In FIG. 2, six of such channels are illustrated, these being indicated at 14, 16, 18, 20, 22, and 24. The channels are distributed with two to a row and the rows of channels being spaced from each other longitudinally along the core panel. In FIG. 2, only one side or face of the core panel is illustrated. It should be understood that ordinarily a duplicate set of channels would be prepared on the opposite side of the door, each channel on one side of the door lying directly opposite a similar channel on the opposite side of the door.

After removing of material to form the channels, what is referred to herein as a support panel is produced. A similar support panel may be produced as the product of a one-step molding operation from moldable material processed with suitably configured molding dies. With this procedure, channels are formed without the removal of material, but as the direct result of the molding operation.

Figure 3:
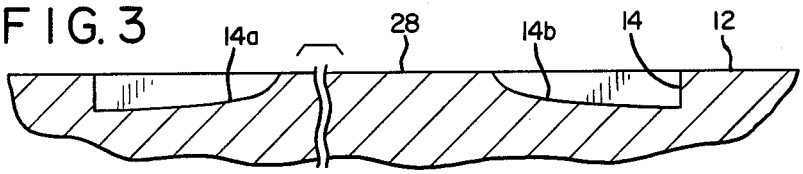
FIG. 3 is a cross-sectional view on a somewhat enlarged scale, taken generally along the line 3—3 in FIG. 2.

As earlier described, each channel encompasses a rectangular region of the surface of panel core 10, depicted in the case of channel 14 by the rectangular region 28. As illustrated in FIG. 3, the surfaces shown at 14*a*, 14*b* that bottom channel 14 incline or slope inwardly into the panel core progressing laterally outwardly of the rectangular region which the channel encompasses.

Figure 5:
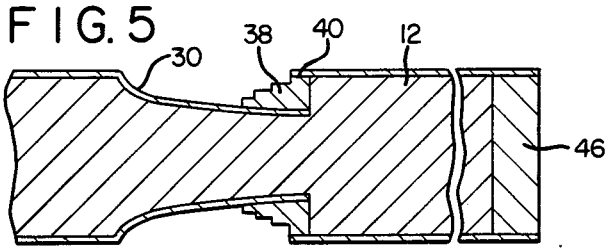
FIG. 5 is a cross-sectional view, taken generally along the line 5—5 in FIG. 4.
Figure 4:
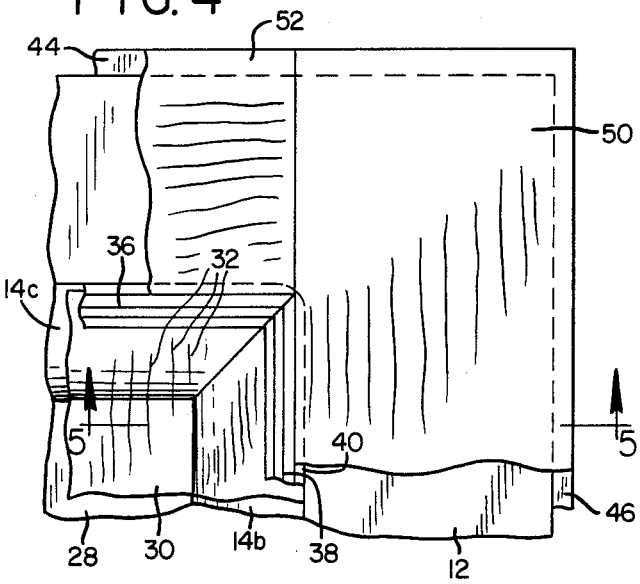
FIG. 4 is a view illustrating in cross section the upper right hand portion of the panel shown in FIG. 2 after the application of veneer overlays and the inlaying of inlay strips within a channel.

With channels present as described, it is convenient at the next step in the door manufacture to apply a veneer overlay to the rectangular region encompassed by each channel and to the surfaces bottoming the channel which encompass each rectangular region. This is illustrated in FIGS. 4 and 5 wherein a veneer overlay 30 is shown which covers central region 28 encompassed by channel 14, as well as bottom surfaces 14*c* and 14*b* of the channel encompassing region 28. The grain of the veneer in this overlay is shown at 32, the grain direction being generally vertical, as would be the case of the grain direction in a panel of a conventional panel-style door.

To cover up margins of each overlay 30 applied to the floor of a channel and the region that it encompasses, inlay strips may be secured in place, as exemplified by strips 36, 38 shown in FIG. 4, one of which extends along the length of each of the legs in a channel. Each inlay strip has an outer margin, shown at 40 for strip 38, which lies flush with surface 12 of the panel where such surface extends laterally outwardly of a channel. Each inlay strip further abuts against the outer side of the leg of the channel which receives the inlay strip.

The inlay strips or molding strips provide a sloping transition between the surface of the panel core where such extends outwardly of a channel and the overlay surfaces which bottom the channel receiving the strips.

In the applying of a veneer overlay and other overlays to be described, the usual adhesive is employed to bond the overlay in place. The inlay strips are also secured in place through appropriate means as through use of a conventional adhesive.

Edges of the door extending along opposite sides and the top and bottom of the door are finished off by applying decorative wood strips, such as those shown at 44, 46. These again may be secured in place as by using an adhesive. Opposite margins of these edge strips lie flush with opposite sides of the core panel.

To finally complete a side of the door, a veneer overlay is applied in covering relation over the surface of the core panel in regions disposed outwardly of the various channels described. Preferably, this veneer overlay comprises veneer strips, such as the one shown at 50 in FIG. 4, which extend along vertical expanses of the surface 12 of the panel, as found at opposite side margins of the door with grain of these strips extending vertically. In horizontal expanses of the panel's surface, such as are found at top and bottom margins of the door, veneer strips 52 are used in the overlay, these strips having grain extending in a horizontal direction. The veneer of this overlay extends over and covers the side margins of edge strips 44, 46 which bound panel core 10 in the completed door and also extends over and covers those margins of the inlay strips which earlier have been described as lying flush with the surface of the panel and as exemplified by margin 40.

In the manufacture of an oak door, oak is the wood ordinarily selected for the edge strips which bound the core panel and the wood of the veneer forming veneer strips 50, 52.

Figure 6:
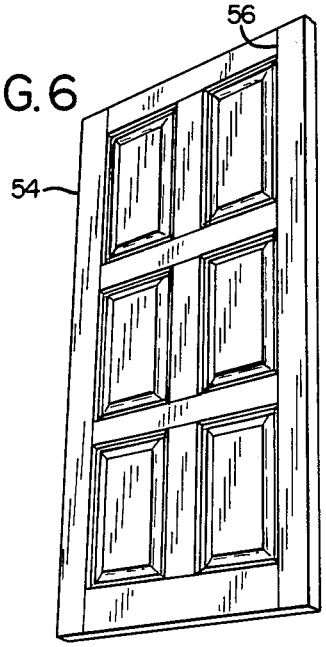
FIG. 6 is a perspective view of a completed door.

A completed door constructed as described, and as shown in FIG. 6 at 54, has an appearance very closely resembling the appearance of a conventional stile and rail door produced using traditional procedures. The entire face of the door is covered with the decorative wood selected. Each rectangular region encompassed by a channel and, in most instances, a major portion of the surfaces bottoming the channel encompassing this rectangular region are exposed in the door, thus to simulate a panel, and have graining in the veneer applied thereover which extends in a uniform direction, normally, vertically when simulating a door of a conventional type.

Joints 56 appear, for instance, at the four corners of the door where horizontally and vertically extending veneer strip overlays meet. These joints impart the visual appearance of the usual joints found between stile and rail members of a conventional door. In fact, however, there are no joints in the core panel at these locations, the joints extending only as deep as the thickness of the veneer strip overlays.

While a preferred embodiment has been described in connection with the door in its manufacture, it should be obvious that variations and modifications are possible without departing from the invention.

It is claimed and desired to secure by letters patent:

1. A method of constructing a raised panel-style door comprising:

providing a core panel having a substantially planar surface extending over one side thereof, forming an elongate channel which extends in a rectangular course over the surface of the core panel and which is bottomed by bottom surfaces recessed inwardly from the surface of the core panel, said channel encompassing a rectangular region of the surface of the core panel, applying a veneer overlay over said region and bottom surfaces adjacent said region, and inlaying the channel with decorative inlay strips and by such inlaying, positioning margins of the inlay strips flush with the core panel surface where the panel surface extends laterally outwardly of the channel, the inlay strips further covering the veneer overlay where the overlay extends over bottom surfaces of said channel.

2. The method of claim 1, which further comprises applying another veneer overlay over the panel surface in regions disposed laterally outwardly of the channel with this other overlay covering said margins of the inlay strips.

3. The method of claim 1, wherein the channel is formed with bottom surfaces that incline inwardly into the core panel progressing laterally outwardly from the rectangular region encompassed by the channel.

4. A method of constructing a raised panel-style door comprising:

providing a core panel having a substantially planar surface extending over one side thereof, forming a plurality of channels, each extending in a rectangular course over the surface of the core panel, the channels encompassing rectangular, panel-simulating regions of the panel surface and the panel surface having remaining regions disposed laterally outwardly of the channels, inlaying each of the channels with inlay strips and by such inlaying, positioning margins of the inlay strips substantially in the plane of the core panel surface and abutting the core panel surface in regions disposed laterally outwardly of the channels, and applying a veneer overlay over said margins of said inlay strips and said core panel surface in regions disposed laterally outwardly of said channels.

5. The method of claim 4, wherein each channel is bottomed by bottom surfaces that slope inwardly into the core panel progressing laterally outwardly of a rectangular region encompassed by a channel, and prior to inlaying of a channel, another veneer overlay is applied over the region of the panel surface encompassed by the channel and bottom surfaces adjacent said region, inlaying of a channel serving to position the inlay strips over margins of said other veneer overlay.

6. A method of constructing a raised panel-style door comprising:

providing a core panel having a substantially planar surface extending over at least one side thereof, forming a plurality of channels, each extending in a rectangular course in the surface of the core panel and each encompassing a rectangular region of the surface of the core panel, each channel having surfaces that bottom it which incline inwardly into the core panel progressing laterally outwardly from the rectangular region encompassed by the channel, overlaying each rectangular region of the surface of the core panel with veneer and with the veneer of the overlay extending over the region and including margins extending in covering relation over the surfaces bottoming the channel encompassing the region, inlaying each of said channels with decorative wood inlay strips with said inlay strips extending over and covering margins of the veneer overlay which cover the surfaces bottoming a channel, said inlay strips including outer margins that are substantially flush with the surface of the core panel where such extends laterally outwardly of a channel, and overlaying with veneer the planar surface of the core panel where such extends outwardly of a channel, the veneer of this overlay extending in covering relation over margins of the inlay strips.

7. A method of constructing a raised panel-style door comprising:

providing a rectangular core panel having a substantially planar surface extending over at least one side thereof, forming a plurality of channels in the surface of the core panel, each channel having the general profile of a picture frame and having a pair of opposed legs, paralleling top and bottom margins of the core panel, and a pair of opposed legs paralleling opposed side margins of the core panel, the channels being located inwardly from top, bottom, and opposite side margins of the core panel and there remaining an uninterrupted planar surface portion extending along the top margin of the core panel, an uninterrupted planar surface portion extending along the bottom margin of the core panel, an opposed uninterrupted planar surface portions extending adjacent opposite side margins of the core panel, inlaying each of said channels with decorative wood inlay strips and by such inlaying, positioning margins of the strips substantially in the plane of the planar surface of the core panel, and overlaying said uninterrupted planar surface portions and margins of the inlay strips with a veneer of decorative wood, said veneer along the top margin of the core panel and along the bottom margin of the core panel extending horizontally thereby to simulate the rail members in a door and said veneer along opposed side margins of the core panel extending vertically thereby to simulate the opposed stile members in a door.

8. The method of claim 7, wherein each channel encompasses a rectangular region of the surface of the core panel and each channel has surfaces bottoming the channel which slope inwardly into the core panel progressing laterally outwardly of the rectangular region that the channel encompasses, and which further comprises overlaying the rectangular region encompassed by each channel and the sloping bottom surfaces of the channel with veneer, the inlaying of each channel with inlay strips being performed after overlaying of the rectangular region encompassed by the channel and with positioning of the inlay strips in covering relation over the overlay for the channel bottom surfaces.

9. A method of constructing a raised panel-style door comprising:

providing a support panel which has formed, on at least one face thereof, multiple channels, each extending in a rectangular course and encompassing a rectangular region of the face of the support panel, the channels being bottomed by bottom surfaces recessed inwardly from the face of the support panel, applying a veneer overlay to the rectangular regions encompassed by the channels and the recessed bottom surfaces of the channels, inlaying each of said channels with inlay strips that extend in covering relation over at least a portion of the veneer in the overlay applied to the recessed bottom surfaces of the channels, the inlay strips having margins flush with the face of the support panel in regions outwardly of the channel, and applying another veneer overlay to the face of the support panel where such extends in regions extending outwardly of the channels, said other overlay further extending in covering relation over said margins of said inlay strips.

* * * * *